US007717236B2

(12) United States Patent
Mustalahti et al.

(10) Patent No.: US 7,717,236 B2
(45) Date of Patent: May 18, 2010

(54) ELEVATOR AND ELEVATOR BRAKE

(75) Inventors: Jorma Mustalahti, Hyvinkää (FI); Esko Aulanko, Kerava (FI)

(73) Assignee: KONE Corporation, Helsinki (FI)

( * ) Notice: Subject to any disclaimer, the term of this patent is extended or adjusted under 35 U.S.C. 154(b) by 0 days.

(21) Appl. No.: 12/155,289

(22) Filed: Jun. 2, 2008

(65) Prior Publication Data

US 2008/0264729 A1 Oct. 30, 2008

Related U.S. Application Data

(63) Continuation of application No. PCT/FI2007/000008, filed on Jan. 10, 2007.

(30) Foreign Application Priority Data

Jan. 16, 2006 (FI) ..... PCT/FI2007/000008

(51) Int. Cl.
*B66B 1/32* (2006.01)

(52) U.S. Cl. ..... 187/288; 187/276; 187/277

(58) Field of Classification Search ..... 187/276, 187/277, 28, 351–379, 288
See application file for complete search history.

(56) References Cited

U.S. PATENT DOCUMENTS 3,762,512 A * 10/1973 McIntyre ..... 188/189
4,977,982 A * 12/1990 Bialy et al. ..... 187/350
5,007,505 A * 4/1991 Lindegger ..... 187/254
5,230,406 A * 7/1993 Poon ..... 187/376
5,310,022 A * 5/1994 Sheridan et al. ..... 187/305
5,363,942 A * 11/1994 Osada ..... 187/376
5,370,208 A * 12/1994 De Jong ..... 187/372
5,386,889 A * 2/1995 Pipes ..... 188/67
5,788,018 A * 8/1998 Mendelsohn et al. ..... 187/404
6,374,953 B1 * 4/2002 Casas ..... 187/399
6,374,964 B2 * 4/2002 Mustalahti et al. ..... 188/186

(Continued)

FOREIGN PATENT DOCUMENTS

DE 2 264 615 9/1974

(Continued)

OTHER PUBLICATIONS

Machine translation of JP 06199483 A.*

(Continued)

*Primary Examiner*—Walter Benson
*Assistant Examiner*—Kawing Chan
(74) *Attorney, Agent, or Firm*—Harness, Dickey & Pierce, P.L.C.

(57) ABSTRACT

An elevator may include a hoisting machine, a set of hoisting ropes, a traction sheave, an elevator car, elevator car guide rails, and a brake. The hoisting machine may engage the set of hoisting ropes via the traction sheave in order to move the elevator car along the elevator car guide rails. The brake may be configured to affect rotational movement of the traction sheave. The brake may include a brake shoe and a braking surface. In an emergency braking situation in which the elevator car is moving upward, the brake shoe may be configured to move in a direction of rotation of the braking surface. An elevator brake may include a brake frame, a brake plate, a wedge piece, a brake shoe, at least one spring element, and at least one electromagnet.

20 Claims, 3 Drawing Sheets

U.S. PATENT DOCUMENTS

| | | | | |
|---|---|---|---|---|
| 2003/0085078 | A1 * | 5/2003 | Simmonds et al. | 187/373 |
| 2005/0126862 | A1 * | 6/2005 | Ito | 187/350 |
| 2007/0170409 | A1 * | 7/2007 | Ito | 254/375 |
| 2007/0227833 | A1 | 10/2007 | Aulanko et al. | |

FOREIGN PATENT DOCUMENTS

| | | | |
|---|---|---|---|
| FI | 20041044 | | 5/2008 |
| JP | 06199483 | A * | 7/1994 |
| JP | 2003042202 | A * | 2/2003 |
| SU | 1 004 250 | | 3/1983 |
| SU | 1 252 298 | | 8/1986 |
| SU | 1744027 | | 6/1992 |
| WO | WO 2005/050051 | | 6/2005 |
| WO | WO 2006/038284 | | 4/2006 |

OTHER PUBLICATIONS

Translation of SU 1004250.*
Machine translation of JP2003042202A.*
Office Action from the European Patent Office dated Jul. 27, 2009, for counterpart European Patent Application No. 07 704 786.8-1256.

* cited by examiner

ELEVATOR AND ELEVATOR BRAKE

This application is a continuation of PCT/FI2007/000008 filed on Jan. 10, 2007, which is an international application claiming priority from FI 20060034 filed Jan. 16, 2006, the entire contents of which are hereby incorporated by reference.

CROSS-REFERENCE TO RELATED APPLICATIONS

BACKGROUND

1. Field

The present invention relates to an elevator and an elevator brake.

2. Description of Related Art

According to the regulations elevators must contain an emergency brake, which is switched on in exceptional situations, such as during an electricity power cut. The normal holding brake of the elevator, for example, is used as an emergency brake, which keeps the elevator car in its position in normal situations when the car is at a landing. Deceleration of the car in normal situations is usually effected as motor braking. Connection of the emergency brake when moving upwards in elevators without counterweight, combined with the earth's gravity, can cause such large deceleration of the elevator car that the safety of the passengers can be endangered. Thus when traveling upwards the emergency brake should not decelerate the elevator car of an elevator without counterweight too effectively or not necessarily at all.

SUMMARY

The elevator and/or elevator brake may eliminate the aforementioned drawback and may be simple and operationally reliable. The elevator and/or elevator brake may avoid unnecessary discomfort or dangerous situations for the passengers. The elevator according to the invention is discussed below. The elevator brake according to the invention is also discussed below. Some embodiments of the invention are characterized by what is disclosed in the claims.

Some inventive embodiments are also discussed in the descriptive section of the present application. The inventive content of the application can also be defined differently than in the claims presented below. The inventive content may also consist of several separate inventions, especially if the invention is considered in the light of explicit or implicit sub-tasks or from the point of view of advantages or categories of advantages achieved. In this case, some of the attributes contained in the claims below may be superfluous from the point of view of separate inventive concepts. Likewise, the different details presented in connection with each embodiment of the invention can also be applied in other embodiments. Problems solved separately can be for example adjustment of the air gap of the brake or the guiding of supporting forces to support in braking occurring in the upward or downward direction.

In the invention the braking exerted on the traction sheave of the brake is reduced in a situation where emergency braking occurs, in which the elevator car is moving upwards, by allowing the brake shoe to follow the movement of the traction sheave for at least some distance. Preferably the normal force exerted on the brake wheel of the brake shoe at the same time is simultaneously allowed to be lighter.

The advantage of the elevator according to the invention and its braking solution is that the upward movement of the elevator car in elevators without counterweight does not slow down too quickly in an emergency braking situation, in which case no danger is caused to the passengers in the car by sudden stopping of the elevator car. A further advantage is the dependable and operationally reliable construction. Another advantage is that the solution according to the invention is suitable for use also in elevators with counterweight, in which case slipping between the hoisting rope and the traction wheel and between the hoisting rope and the diverting pulleys caused by sudden deceleration can be prevented. This saves at least both the rope and the traction wheel and diverting pulleys.

BRIEF DESCRIPTION OF THE DRAWINGS

In the following, the invention will be described in more detail by the aid of some example of its embodiment with reference to the attached drawings, wherein FIG. 3 presents a side view of a sectioned part of a brake appliance of an elevator according to FIG. 2, in which the brake lightening function is switched on.

DETAILED DESCRIPTION OF EXAMPLE EMBODIMENTS

Figure 1:
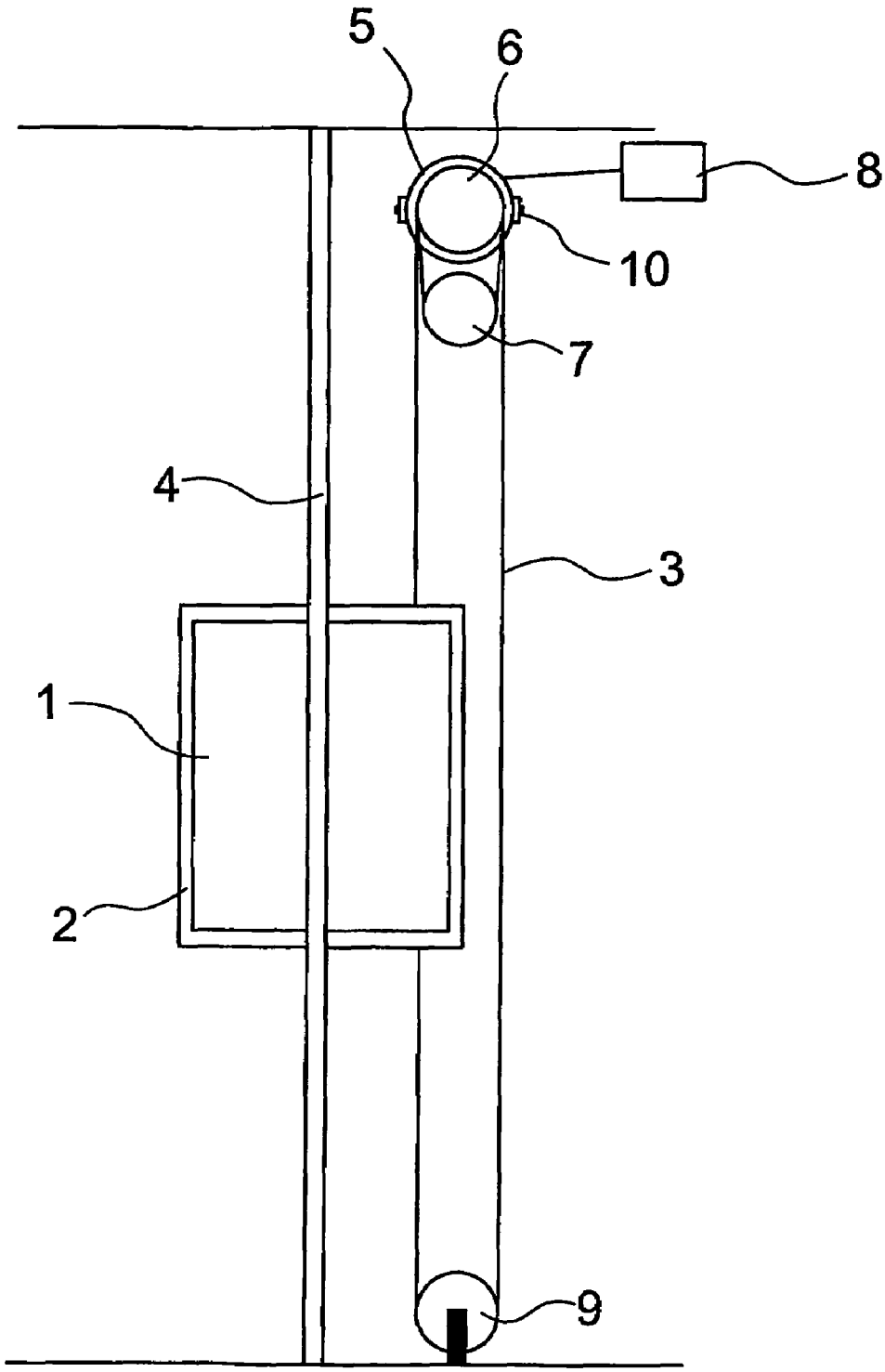
FIG. 1 presents a diagrammatic and simplified side view of a traction sheave elevator without counterweight applicable to the solution according to the invention.

FIG. 1 presents a diagrammatic and simplified side view of one traction sheave elevator without counterweight applicable to the solution according to the invention, which comprises at least an elevator hoisting machine 5 with hoisting motor, a traction sheave 6, an elevator control system 8, as well as an elevator car 1 in a car sling 2 moving in an essentially vertical direction along guide rails 4, which is suspended on hoisting ropes 3. The first end of the hoisting ropes 3 is fastened to the top part of the car sling 2, from where it is led to pass around and over the traction sheave 6, and then under the diverting pulley 7 of the hoisting machine 5 and next over the traction sheave 6 again, from where it goes under the diverting pulley 9 fixed to the bottom of the elevator shaft, and then on to the bottom part of the car sling 2, to which the second end of the hoisting ropes 3 is fastened. The elevator receives its lifting force from the hoisting machine 5 as a result of the friction between the traction sheave 6 and the hoisting ropes 3. The roping suspension presented in FIG. 1 is a simplified roping construction for an elevator without counterweight. Often the hoisting rope 3 is led to pass via numerous diverting pulleys, so that the suspension ratio is of the magnitude desired. In addition the hoisting machine contains e.g. two brakes 10, which are positioned on opposite sides of the center axis. The brake 10 is primarily a holding brake, which keeps the elevator car 1 in its position when the car is at a landing. Normally braking of the movement of the elevator car occurs as motor braking by means of the hoisting motor. The brake 10 is also used for emergency braking, in which case very great deceleration is achieved with the brake, especially in an elevator without counterweight, owing to the good friction between the hoisting ropes and the traction sheave 6. Deceleration that is too great is a problem, especially in elevators without counterweight when moving upwards, as mentioned above. For this reason the braking force of the brake 10 according to this invention is reduced by lightening the compression of the brake shoes on the brake wheel, if the brake 10 is switched on while the elevator car 1 is moving upwards.

Figure 2:
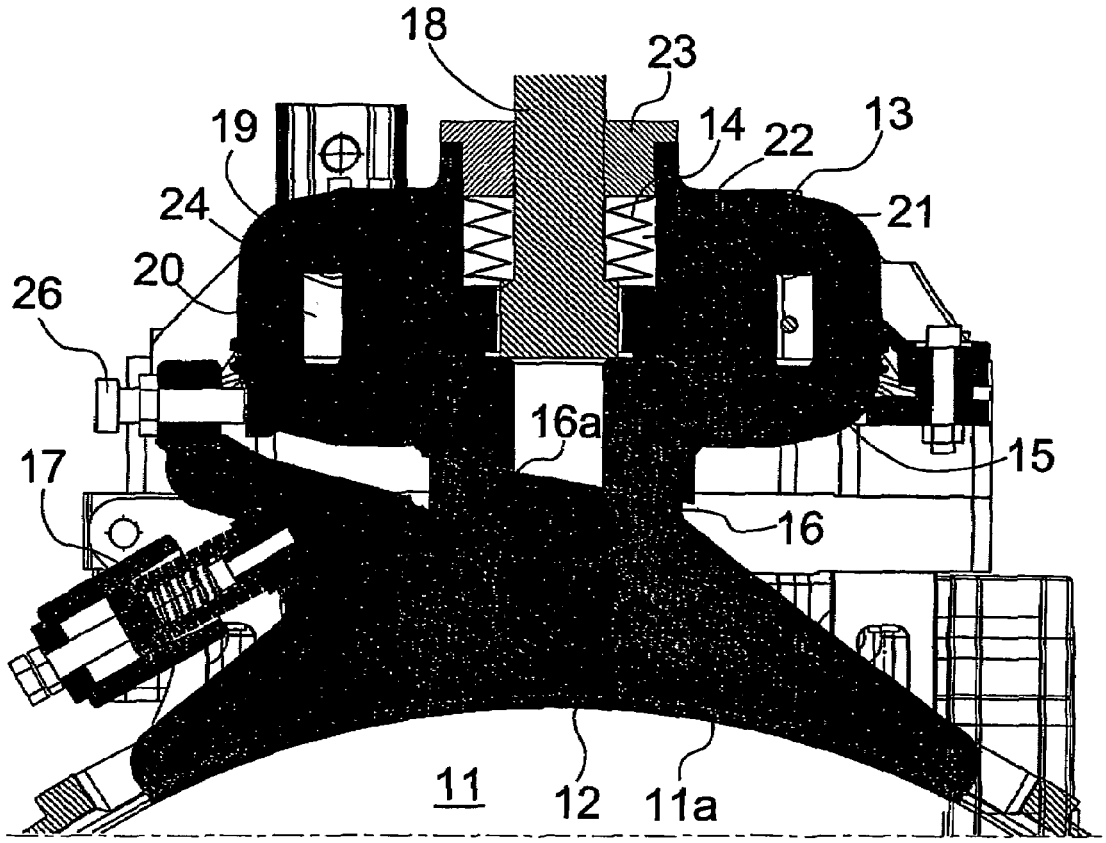
FIG. 2 presents a side view of a sectioned part of the brake appliance of an elevator, in which one embodiment of the solution according to the invention is used

FIG. 2 presents a side view of a sectioned part of the brake appliance of an elevator, in which one embodiment of the solution according to the invention is used. The brake is presented in a situation in which the brake is activated while the elevator is stationary, but the brake is in almost the same position also when emergency braking is effected when the elevator car is moving downwards.

The hoisting machine 5 comprises at least a fixed stator and a rotating rotor, along with which a brake wheel 11 provided with a braking surface 11*a* rotates. Additionally a traction sheave 6 is fixed to the rotor so that it rotates with the rotor. The brake 10 comprises at least a brake frame 13 fixed to the hoisting machine 5, containing at least one electromagnet 20 equipped with windings. A brake plate 15 fitted to move in relation to the frame is located on the brake frame 13, between the brake wheel 11 and the frame 13, and a brake shoe 12 provided with a wedge piece 16 is further located between the brake plate 15 and the brake wheel 11 such that the wedge piece 16 is between the brake plate 15 and the brake shoe 12. The wedge surface of the wedge piece 16 on the side of the brake plate 15 and correspondingly the surface of the brake plate 15 on the side of the wedge piece together form a substantially straight first sliding surface 16*a*, which is inclined to an angle, which opens the brake wheel 11 in that direction of rotation in which the elevator car 1 moves upwards. The aforementioned direction of rotation is marked in the figure with the arrow A. In addition the second sliding surface 25 between the wedge piece 16 and the brake shoe 12 as viewed from the side is curved such that the wedge piece 16 slides on the sliding surface 25 in relation to the brake shoe 12, but the wedge piece 16 does not come out from between the brake plate 15 and the brake shoe 12. Preferably the wedge angle between the brake plate 15 and the wedge piece 16 is appreciably greater than the friction angle between them, and even better: in addition to or alongside a sufficient wedge angle the ease of a change in the inter-positioning of the brake plate 15, the wedge piece 16 and the brake shoe 12 is achieved with a selection of materials suitable for these pieces in which case the friction between the brake plate 15, the wedge piece 16 and the brake shoe 12 at their mutual sliding surfaces is slight.

The brake frame 13 contains a center hole in the center of the frame and extending through the frame, in which is a bore 24 extending through the frame on the side of the brake plate 15 and at least a second bore 22 with the same center, which is open to the opposite side of the brake plate 15 of the frame 13. The bore 22 does not extend through the frame 13 and the diameter of the bore 22 is greater than the diameter of the bore 24 such that at the meeting point of the bores inside the frame is a ring-like collar 21. In addition a presser pin 18 is fitted to pass through the bores 22, 24, of which the diameter of the part mainly situated in the bore 24 is greater than the diameter of the part mainly in the bore 22, such that there is a ring-like collar 19 on the presser pin 18 at the meeting point of the different diameters. The length of the part of the presser pin 18 of greater diameter is selected to be such that it is essentially greater than the length of the smaller diameter bore 24 of the center hole. A disc spring pack 14 locked at its first end with a locking element 23 is located around the presser pin 18 in the larger diameter bore 22, which is fitted to press the presser pin 18 at its second end via the collars 19 towards the brake shoe 12. The brake plate 15 contains a stop surface, against which the presser pin 18 presses and causes movement of the brake plate towards the brake shoe 12 in the braking phase.

In a braking situation current is disconnected from the electromagnets 20, whereupon the disc spring pack 14 presses the presser pin on the collar 19 towards the brake wheel 11. The presser pin 18 for its part presses the brake plate 15, and the brake shoe 12 via both the brake plate and the wedge piece 16, towards the brake wheel 11. The collars 21 in the smaller diameter bore 24 of the frame prevent the disc spring pack 14 from pressing the presser pin 18 too long a distance towards the brake wheel 11. When the brake is not activated, the electromagnets 20 keep the brake shoe 12 detached from the braking surface 11*a* of the brake wheel 11. FIG. 2 presents only one brake 10, the other is situated for example on the opposite side of the hoisting machine 5. In this case the brake 10 is on the upper and lower part of the hoisting machine, while in the solution according to FIG. 1 it is on the sides of the hoisting machine.

Figure 3:
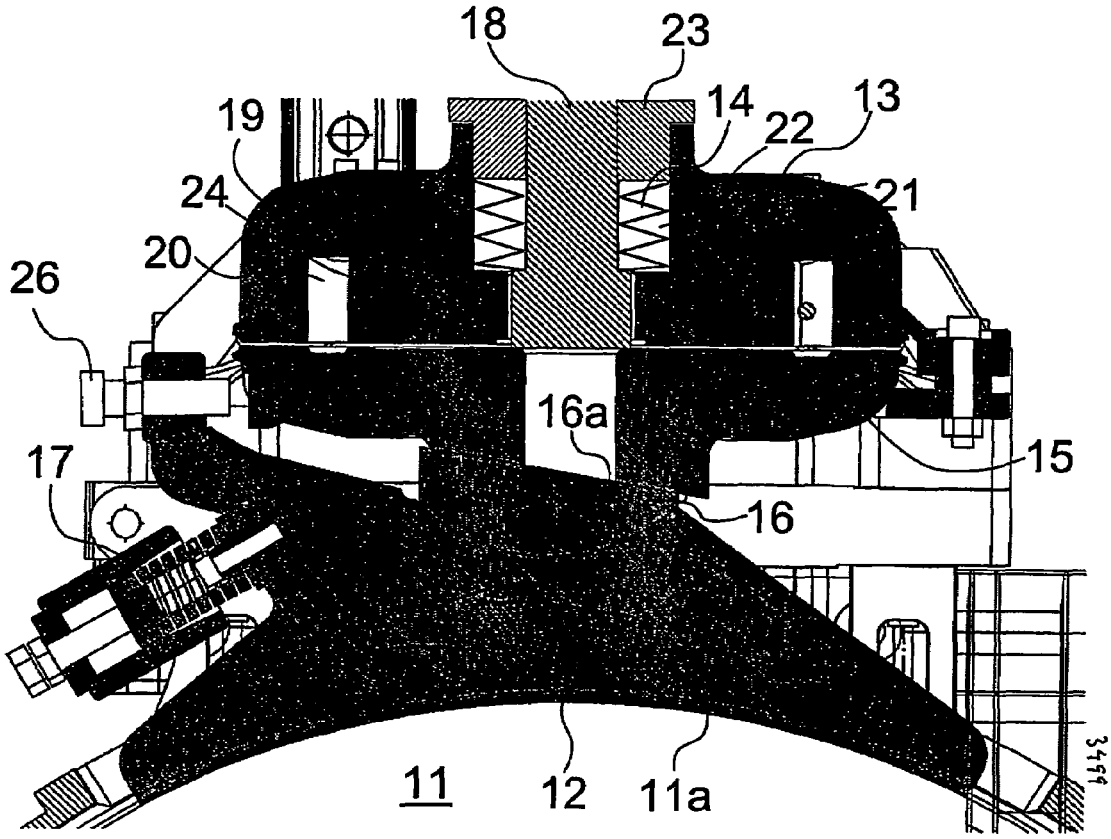

FIG. 3 presents a part of a brake appliance of an elevator according to the invention in a situation in which the brake lightening function is switched on, when the emergency braking occurs while the elevator car is moving upwards. The idea of the invention is that when the elevator car 1 is moving upwards, the brake 10 does not substantially slow down the speed, even if the emergency braking is switched on e.g. in the event of an electricity power cut. Likewise, when the elevator car 1 is stationary or is moving downwards and the brake 10 is connected, the brake 10 operates in the conventional manner of a brake—i.e. it keeps the car 1 in its position or slows down downward movement. This is possible with the same brake due to the wedge solution of the invention.

When the elevator car 1 is moving upwards the brake wheel 11 rotates in the situation of the figure counterclockwise in the direction of the arrow A. When the brake 10 is switched on while driving upwards, the mutual shaping of the wedge piece 16 on the brake shoe 12, the brake plate 15 and the brake shoe 12 enable the brake shoe 12 to move along with the brake wheel 11 in the direction of rotation of the braking surface 11*a* owing to the friction between the shoe and the braking surface 11*a*, in other words in the direction of the arrow A. The wedge piece 16 then moves in relation to the sliding surfaces 16*a* and 25 and at the same time the brake shoe 12 moves away from the braking surface 11*a*. The brake shoe 12 does not however manage to move too long a distance, because the spring-action stop and return element 17 supported against the frame prevents movement of the brake shoe 12 after a pre-determined distance. When the brake shoe 12 has moved far enough to the side below the brake plate 15, the lowest springs of the disc spring pack 14 engage the collar 21 in the center hole of the frame 13, whereupon the presser pin 18 no longer presses the brake plate 15 closer to the brake wheel 11. In this case the aforementioned compression towards the brake wheel 11 is no longer exerted on the brake shoe 12 and the brake shoe 12 is able to move a little away from the braking surface 11*a*, whereupon there is no longer any substantial braking force and the elevator car stops softly under the influence of the earth's gravity.

When the movement of the elevator car 1 upwards has stopped due to the earth's gravity, the elevator car simultaneously tries to move immediately downwards. In this case the brake shoe 12 wedges back into its normal position due to the spring force of the stop and return element 17 and also due to the friction between the brake shoe 12 and the braking surface 11*a*, if the elevator car 1 has continued its downward movement after stopping. The brake 10 then stops the elevator car in its position and the brake thereafter operates as a normal holding brake. By adjusting the spring force of the stop and return element it is also possible to set the force of braking occurring in the upward direction to at least some extent.

The arrester element 26, which is presented in the figure as an adjuster screw, determines together with the spring of the return element 17 the resting position of the brake shoe 12. The arrester element 26 also prevents, at least for its part, the brake shoe from following the movement of the brake wheel when braking occurs in the downward direction. The arrester element 26 receives support for bearing braking in the downward direction from the brake plate 15 or possibly from another part of the brake. The adjuster screw functioning as the arrester element also determines within the scope of its adjustment tolerance the height of the entity jointly formed by the brake shoe 12, the brake plate 15 and the wedge piece 16 in the direction of the brake stroke, in which case the air gap between the brake shoe 12 and the braking surface 11*a* is easily adjustable.

It is obvious to the person skilled in the art that the invention is not limited solely to the example described above, but that it may be varied within the scope of the claims presented below. Thus, for example, the lightening of the braking force in an emergency braking situation can also be implemented with separate device structures than that presented above. Instead of mechanical lightening of the braking force, the braking force can be lightened electrically with electromagnets or also hydraulically.

It is also obvious to the person skilled in the art that the suspension ratio of the elevator can be greater than a 1:1 ratio. For example 2:1, 4:1, 8:1 ratios, and also other ratios, including uneven ratios, are easy to implement from the standpoint of the invention.

It is further obvious to the person skilled in the art that the invention is suitable for use also, apart from in elevators without counterweight, in e.g. those types of elevators with counterweight, in which the counterweight is at most the weight of the empty elevator car. In this case slipping between the hoisting rope and the traction wheel and between the hoisting rope and the diverting pulleys caused by sudden deceleration can be prevented.

The invention claimed is:

1. An elevator, comprising:

A hoisting machine;

A set of hoisting ropes;

A traction sheave;

An elevator car;

Elevator car guide rails; and

A brake;

wherein the hoisting machine comprises a brake wheel with a braking surface, wherein the hoisting machine engages the set of hoisting ropes via the traction sheave in order to move the elevator car along the elevator car guide rails, wherein the brake is configured to affect rotational movement of the traction sheave, wherein the brake comprises:

a brake frame;

a brake shoe between the brake frame and the braking surface;

a brake plate between the brake frame and the brake shoe; and a wedge piece between the brake plate and the brake shoe;

wherein in a normal braking situation or in an emergency braking situation, a member of the brake frame is configured to urge the brake plate against the wedge piece in order to move the brake shoe toward the braking surface, and wherein in the emergency braking situation, when the elevator car is moving upward, the brake shoe is configured to move in a direction of rotation of the braking surface, and the movement of the brake shoe in the direction of rotation of the braking surface is configured to lighten a normal force between the brake shoe and the braking surface.

2. The elevator of claim 1, wherein the brake further comprises:

a stop and return element;

wherein when the brake is engaged in the emergency braking situation, when the elevator car is moving upward, the brake shoe moves in the direction of rotation of the braking surface until stopped by the stop and return element.

3. The elevator of claim 1, wherein when the brake is engaged in the emergency braking situation, when the elevator car is moving downward, the brake shoe does not move in the direction of rotation of the braking surface.

4. The elevator of claim 1, wherein when the brake is engaged in the normal braking situation, when the elevator car is moving upward, the brake shoe does not move in the direction of rotation of the braking surface.

5. The elevator of claim 1, wherein when the brake is engaged in the normal braking situation, when the elevator car is moving downward, the brake shoe does not move in the direction of rotation of the braking surface.

6. The elevator of claim 1, wherein the brake plate comprises:

a first sliding surface;

wherein the first sliding surface is inclined so that, in the emergency braking situation, when the elevator car is moving upward, the wedge piece slides on the first sliding surface in order to allow the brake shoe to move in the direction of rotation of the braking surface.

7. The elevator of claim 6, wherein the first sliding surface is substantially flat.

8. The elevator of claim 1, wherein the brake shoe comprises:

a second sliding surface;

wherein in the braking situation, when the elevator car is moving upward, the wedge piece slides on the second sliding surface in order to allow the brake shoe to move in the direction of rotation of the braking surface.

9. The elevator of claim 8, wherein the second sliding surface is curved.

10. The elevator of claim 1, wherein the elevator is without counterweight.

11. The elevator of claim 1, wherein the brake plate comprises a first sliding surface, wherein the brake shoe comprises a second sliding surface, and wherein in the emergency braking situation, when the elevator car is moving upward, the wedge piece slides on the first and second sliding surfaces in order to allow the brake shoe to move in the direction of rotation of the braking surface.

12. An elevator, comprising:

a hoisting machine;

a set of hoisting ropes;

a traction sheave;

an elevator car;

elevator car guide rails; and a brake;

wherein the hoisting machine comprises a brake wheel with a braking surface, wherein the hoisting machine engages the set of hoisting ropes via the traction sheave in order to move the elevator car along the elevator car guide rails, wherein the brake is configured to affect rotational movement of the traction sheave, wherein the brake comprises:

a brake frame;

a brake shoe between the brake frame and the braking surface;

a brake plate between the brake frame and the brake shoe; and a wedge piece between the brake plate and the brake shoe;

wherein in a normal braking situation or in an emergency braking situation, a member of the brake frame is configured to urge the brake plate against the wedge piece in order to move the brake shoe toward the braking surface, wherein in the emergency braking situation, when the elevator car is moving upward, the brake shoe is configured to move in a direction of rotation of the braking surface, and wherein in the emergency braking situation, when the elevator car is moving upward, the movement of the brake shoe in the direction of rotation of the braking surface is configured to lighten a normal force between the brake shoe and the braking surface.

13. An elevator brake for an elevator comprising a hoisting machine that comprises a brake wheel with a braking surface, the elevator brake comprising:

a brake frame;

a brake shoe between the brake frame and the braking surface;

a brake plate between the brake frame and the brake shoe;

a wedge piece between the brake plate and the brake shoe;

at least one spring element; and at least one electromagnet;

wherein the brake plate is configured to move with respect to the brake frame, wherein the brake shoe is configured to move with respect to the brake frame, wherein the at least one spring element is configured to engage the elevator brake by causing the brake plate to move with respect to the brake frame so that a distance between the brake plate and the brake frame increases, wherein the at least one electromagnet is configured to disengage the elevator brake by causing the brake plate to move with respect to the brake frame so that the distance between the brake plate and the brake frame decreases, and wherein the wedge piece is configured to move between the brake plate and the brake shoe.

14. The elevator brake of claim 13, wherein the wedge piece is configured to move in relation to both the brake plate and the brake shoe.

15. The elevator brake of claim 13, wherein the brake plate comprises:

a first sliding surface;

wherein the wedge piece slides on the first sliding surface, and wherein the first sliding surface is substantially flat.

16. The elevator brake of claim 13, wherein the brake shoe comprises:

a second sliding surface;

wherein the wedge piece slides on the second sliding surface, and wherein the second sliding surface is curved.

17. The elevator brake of claim 13, wherein the brake further comprises:

a stop and return element;

wherein the stop and return element is configured to limit the movement of the brake shoe with respect to the brake frame.

18. The elevator brake of claim 13, wherein the brake further comprises:

a stop and return element;

wherein the stop and return element is configured to return the brake shoe to a normal position with respect to the brake frame.

19. The elevator brake of claim 13, wherein the brake further comprises:

an arrester element;

wherein the arrester element is configured to transmit braking forces of the elevator from the brake plate to the wedge piece and the brake shoe.

20. The elevator brake of claim 13, wherein the brake plate comprises a first sliding surface, wherein the brake shoe comprises a second sliding surface, and wherein the wedge piece is configured to move between the brake plate and the brake shoe by sliding on the first and second sliding surfaces.

* * * * *